US008631968B2

(12) United States Patent
Taylor

(10) Patent No.: US 8,631,968 B2
(45) Date of Patent: Jan. 21, 2014

(54) TISSUE ADVANCEMENT DEVICE FOR TISSUE BOXES

(76) Inventor: Tony A. Taylor, Las Vegas, NV (US)

( * ) Notice: Subject to any disclaimer, the term of this patent is extended or adjusted under 35 U.S.C. 154(b) by 0 days.

(21) Appl. No.: 13/153,411

(22) Filed: Jun. 4, 2011

(65) Prior Publication Data

US 2012/0305586 A1 Dec. 6, 2012

(51) Int. Cl.
*A47K 10/44* (2006.01)
*B65H 1/00* (2006.01)

(52) U.S. Cl.
USPC ..... 221/57; 221/36; 221/46; 221/58

(58) Field of Classification Search
USPC ..... 221/57, 59, 65, 53, 54, 58, 151, 154, 221/282–284, 286, 312 R, 312 B, 152, 185, 221/254, 270, 36–37, 45–46, 56; 53/261–262; 160/192; 224/462; 211/105.5–105.6; 248/561, 346.04; 271/219; 229/117.19; 312/190–191; 220/559, 720, 89.1
See application file for complete search history.

(56) References Cited

U.S. PATENT DOCUMENTS 920,632 A * 5/1909 Oliver ..... 221/57
1,901,243 A * 3/1933 Horwitt ..... 221/279
2,886,391 A * 5/1959 Simpson ..... 312/71
3,066,825 A * 12/1962 Saxe ..... 221/59
3,121,510 A * 2/1964 Holzwarth et al. ..... 221/60
3,306,566 A * 2/1967 Paulson et al. ..... 248/346.04
3,425,595 A * 2/1969 Shapira ..... 221/52
3,767,083 A * 10/1973 Webb ..... 221/279
4,045,102 A * 8/1977 Austin ..... 312/61
4,664,507 A * 5/1987 Fukae et al. ..... 347/138
4,838,436 A * 6/1989 Bailey ..... 211/51
4,905,869 A * 3/1990 Grigsby et al. ..... 221/92
4,915,273 A * 4/1990 Allen ..... 224/462
4,997,105 A * 3/1991 Fischer ..... 221/45
5,562,328 A * 10/1996 Schottenfeld ..... 312/35
6,552,284 B1 * 4/2003 Drago ..... 200/83 R
7,178,689 B2 * 2/2007 Wieser et al. ..... 221/52
7,568,593 B2 * 8/2009 Cittadino et al. ..... 221/59
2006/0102641 A1 * 5/2006 Cittadino et al. ..... 221/45

* cited by examiner

*Primary Examiner* — Michael K Collins
(74) *Attorney, Agent, or Firm* — Ariel S. Bentolila; Bay Area IP Group, LLC

(57) ABSTRACT

An apparatus comprises a first plate being configured for supporting a quantity of tissues within a tissue dispenser box. A second plate is configured for resting on a bottom portion of the tissue dispenser box. A resilient structure is configured for urging the first plate in an upward direction. The resilient structure is further configured to be positioned between the first plate and the second plate. Attachment mechanisms are joined to a bottom portion of the first plate and a top portion of the second plate. The attachment mechanisms are configured for joining the resilient structure to the first plate and the second plate.

11 Claims, 2 Drawing Sheets

TISSUE ADVANCEMENT DEVICE FOR TISSUE BOXES

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to personal care items. More particularly, the invention relates to a tissue advancement device for facial tissue boxes.

BACKGROUND OF THE INVENTION

The present invention relates to a device that keeps tissues pushed up toward the retrieval point of a tissue box. When a tissue box is full accessing the tissue is easy, as a tissue typically sticks out through the top of the box. As one tissue is pulled out it automatically causes the next tissue in line to take its place. This process works well with a new or fairly full tissue box. However, when the tissue box is not full yet still has some tissues in it, as the protruding tissue is pulled out of the box the next tissue does not always take its place. This is because the frictional cling between the top tissue and its immediate follower is not enough to ensure that the following tissue extends the distance between the tissues in the box and the opening of the box to be exposed through the opening of the box. Instead, the other tissues often fall back to the bottom of the box. When this happens a user must reach into the box to retrieve a tissue for use. As the contents of the tissue box become less, this retrieval process occurs more and more until the box is fully depleted.

There are many problems with reaching into a tissue box to retrieve a tissue. For example, when a user needs a tissue in a hurry and must reach into the tissue box, the user usually extracts multiple tissues, which is wasteful. Also, since the user must reach into the box, the user may not retrieve a tissue as quickly as they need it. Also, reaching in through the top of the box causes the slit at the top of the box to become wider and bigger, which means the box cannot grip tissue very well and only exacerbates the problem of the tissue falling to the bottom of the box. In addition, reaching in for tissue is not convenient and can be time consuming, wasteful and difficult for anyone with grip, mobility or dexterity problems such as a person with arthritis of the hands or carpel tunnel. Furthermore, reaching into the tissue box can dirty and possibly contaminate the remaining tissues, as any germs or nasal discharge that may be on the hands gets transported into the tissue box where these germs can collect and even multiply.

In view of the foregoing, there is a need for improved techniques for generally ensuring that tissues in a tissue box remain near the opening of the box.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a front perspective view of the device in a closed position. FIG. 1B is a front perspective view of the device in an open position. FIG. 1C is a top perspective view of the device, and FIG. 1D is a bottom perspective view of the device;

FIG. 3A is a side perspective view of the device being inserted into the tissue box, and FIG. 3B is a partially transparent side perspective view of the device in use in the tissue box;

Figure 1A:
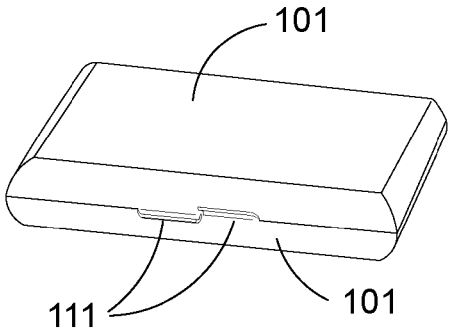
FIGS. 1A, 1B, 1C, and 1D illustrate an exemplary tissue advancement device, in accordance with an embodiment of the present invention.

Unless otherwise indicated illustrations in the figures are not necessarily drawn to scale.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although claims have been formulated in this application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new claims may be formulated to such features and/or combinations of such features during the prosecution of the present application or of any further application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

A preferred embodiment of the present invention and at least one variation thereof provide a tissue advancement device that generally ensures that facial tissue is conveniently accessible in an individual container even when the total contents of the container is low. In many preferred embodiments, the tissue advancement device comprises a spring-loaded platform that fits upon the interior floor of a facial tissue container and advances the tissues upward towards the retrieval aperture of the container. Some preferred embodiments also comprise a stud/aperture locking system that enables the device to be locked in a closed position when the device is not in active use to require less storage space.

Figure 1B:
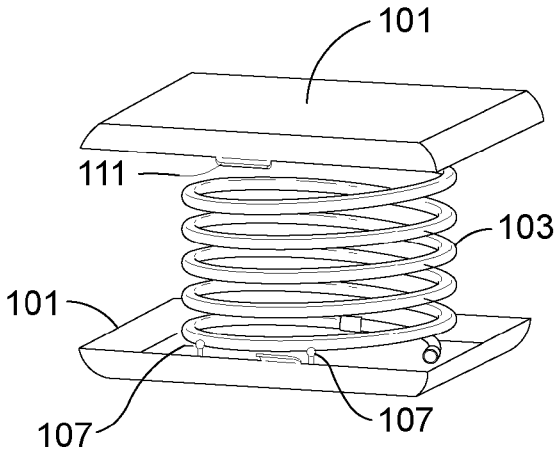
Figure 1C:
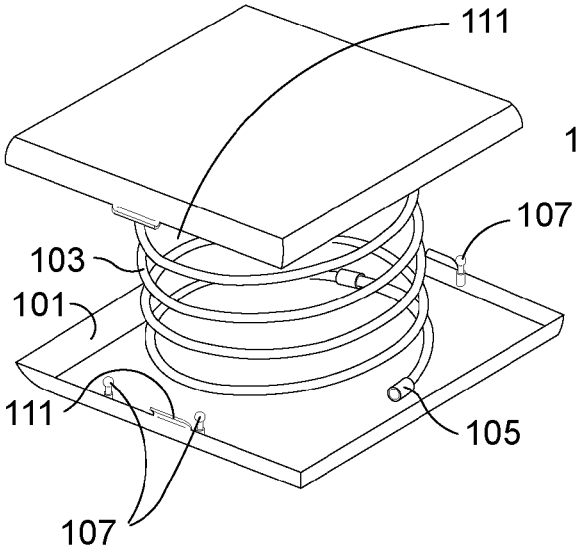
Figure 1D:
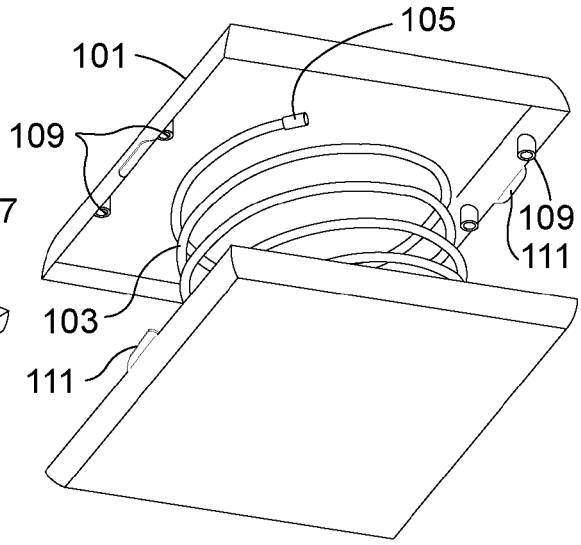

FIGS. 1A, 1B, 1C, and 1D illustrate an exemplary tissue advancement device, in accordance with an embodiment of the present invention. FIG. 1A is a front perspective view of the device in a closed position. FIG. 1B is a front perspective view of the device in an open position. FIG. 1C is a top perspective view of the device, and FIG. 1D is a bottom perspective view of the device. In the present embodiment the device comprises two plates 101 and a spring 103 between plates 101. Plates 101 are preferably made of a lightweight plastic material such as, but not limited to, polystyrene (PS) or polyvinyl chloride (PVC); however, in alternate embodiments the plates may be made of various different materials including, but not limited to, cardboard, lightweight metal, fiberglass, etc. In some alternate embodiments, the plates can be made of recycled materials and may be recyclable itself. In the present embodiment, plates 101 measure approximately four inches in length by four inches in width by one-eighth of an inch in depth (4"×4"×⅛"). Plates 101 feature a concave design with a rounded perimeter that forms a radius edge about plates 101 when in the closed position. This creates a small hollow center area between plates 101 in the closed position to accommodate spring 103. In alternate embodiments the plates may have various different sizes and shapes of applicability for use within a variety of facial tissue containers. For example, without limitation, some alternate embodiments may be implemented without a radius edge. Some alternate embodiments may be in made in sizes and shapes for specific application within particular tissue containers of specific sizes and shapes. In the present embodiment, the maximum height of the device is preferably a half inch (½") or less.

Referring to FIGS. 1C and 1D, in the present embodiment, spring 103 attaches to the interior planes of each plate 101 within hosting sleeves 105, included upon and as direct portions of the structure of plates 101. Spring 103 is situated into sleeves 105 in order to hold it in place. Those skilled in the art, in light of the present teachings, will readily recognize that a multiplicity of suitable attachment means may be used to hold the spring in place in alternate embodiments including, without limitation, grooves in the plates, tightly wrapping the ends of the spring around cylindrical projections on the plates, snugly inserting the ends of the springs into round indentations in the plates, adhesives, etc. Spring 103 must be durable and must be able to be compressed enough to enable plates 101 to lock together. Additionally, when plates 101 are released, spring 103 must be strong enough to push the top plate 101 and tissue upward. In the present embodiment, spring 130 is preferably made of oil-tempered (OT) wire of an approximate one-eighth of an inch (⅛") gauge; however, various different materials may be used in alternate embodiments including but not limited to steel wire, various alloys, different gauges of wire, plastic, etc. In the present embodiment, spring 103 is coiled to form an approximate four-inch (4") diameter, and the maximum extending length of spring 103 is approximately six inches (6"). Spring 103 has a minimum height of three eighths of an inch (⅜") when fully compressed. In alternate embodiments the spring can be produced in various maximum extending lengths and minimum heights to accommodate use in facial tissue containers of various unit quantities and heights. Furthermore, the spring can be produced in various different tension strengths. It is contemplated that various different types of springs may be used in tissue advancement devices in alternate embodiments. For example, without limitation, in one alternate embodiment, the spring may be conical with the top of the spring having a narrower circumference than the bottom to enable the spring to compress to a smaller height. Other types of springs that may be suitable for use in alternate embodiments include, without limitation, volute springs, flat springs, cantilever springs, etc. Some alternate embodiments may comprise multiple springs. In the present embodiment, the device is completely assembled when purchased by a user. However, replacement springs may be optionally made available if spring 103 needs to be replaced for example, without limitation, if spring 103 breaks or loses its resiliency. To replace spring 103, the user removes spring 103 from sleeves 105 and then places the replacement spring into sleeves 105.

Referring to FIGS. 1C and 1D, in the present embodiment, four extending studs 107 of an approximate quarter-inch (¼") length are featured on the interior plane of one plate 101 which are in alignment with four apertures 109 featured on the interior plane of the second plate 101. Two stud 107 and aperture 109 combinations are featured on one side of the device while the other set of two studs 107 and apertures 109 is featured on the opposite wall. In alternate embodiments the configuration of the stud and aperture combinations may vary. For example, without limitation, in one alternate embodiment one stud and aperture combination may be placed in each corner of the device. In other alternate embodiments, each plate may comprise both studs and apertures rather than placing all of the studs on one plate and all of the apertures on the other plate. In the present embodiment, studs 107 have a small bulb head to be securely held in apertures 109; however, in some alternate embodiments the studs may not comprise bulb heads. The male/female design of stud 107 and aperture 109 combinations acts as the locking mechanism of the device to keep plates 101 in the closed position, as shown by way of example in FIG. 1A. When the device is in the closed position, spring 103 is entirely compressed and plates 101 contact one another so the device is compressed to its thinnest point. Those skilled in the art, in light of the present teachings, will readily recognize that the two plates in alternate embodiments may be secured upon one another using means other than interlocking studs and apertures such as, but not limited to, clasp formats, spring-loaded tabs, hook and loop tabs, snaps, straps, clamps, latches, etc. Other alternate embodiments may be implemented without interlocking studs and apertures or any other locking means.

Referring to FIGS. 1A through 1D, the same two sides of plates 101 hosting stud 107 and aperture 109 combinations feature finger tabs 111 which project approximately one quarter of one inch (¼") perpendicularly from the plane of plates 101. Tabs 111 are in pairs with one tab 111 projecting from the top plate 101 and the other tab 111 projecting from the bottom plate 101. Tabs 111 provide the user with something to grip when releasing plates 101 from the closed position. Tabs 111 are situated near stud 107 and aperture 109 combinations so the user's force is focused near these locking means to easily disengage studs 107 from apertures 109. Alternate embodiments of the present invention may be implemented without extending tabs on the plates.

Figure 2:
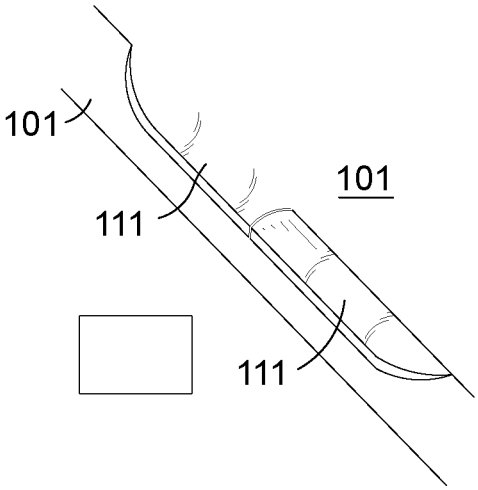
FIG. 2 is a top perspective view of exemplary finger tabs on a tissue advancement device in a closed position, in accordance with an embodiment of the present invention.

FIG. 2 is a top perspective view of exemplary finger tabs 111 on a tissue advancement device in a closed position, in accordance with an embodiment of the present invention. In the present embodiment, finger tabs 111 project outward horizontally from the edge of the device with one tab 111 projecting from a top plate 101 and another tab 111 projecting from a bottom plate 101. Tabs 111 are positioned to lie immediately next to each other when plates 101 make contact. Tabs 111 enable a user to easily unlock the device with a small finger flip to enable the spring of the device to push the top plate 101 away from the bottom plate 101. Tabs 111 slant back toward plates 101 at their exterior edges. This design makes tabs 111 strong and durable and requires less plastic to produce. However, tabs in alternate embodiments may have various different designs such as, but not limited to, rounded designs, rectangular designs, spherical designs, etc.

Figure 3A:
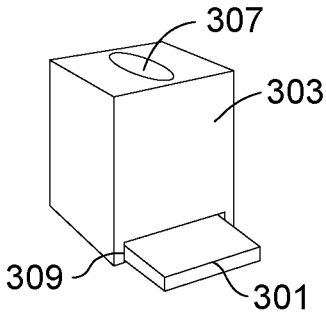
FIGS. 3A and 3B illustrate an exemplary tissue advancement device in use in a columnar tissue box, in accordance with an embodiment of the present invention.
Figure 3B:
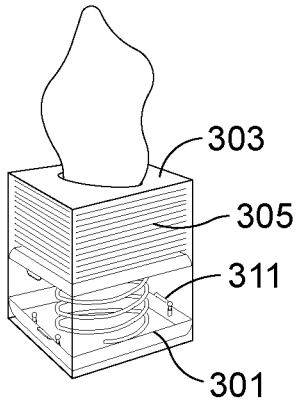

FIGS. 3A and 3B illustrate an exemplary tissue advancement device 301 in use in a columnar tissue box 303, in accordance with an embodiment of the present invention. FIG. 3A is a side perspective view of device 301 being inserted into tissue box 303, and FIG. 3B is a partially transparent side perspective view of device 301 in use in tissue box 303. In typical use of the present embodiment, once the contents of tissue box 303 reduces in quantity to the point where tissues 305 are not near an aperture 307 of box 303, a user may turn box 303 upside down and cut a slot 309 into the lower sidewall of box 303. Slot 309 only needs to be big enough to accommodate device 301. The user may then release a spring 311 of device 301 by separating its projecting tabs and releasing the studs from their hosting apertures, as described by way of example above in accordance with FIGS. 1C and 1D. Then, while holding device 301 in its closed position, the user places device 301 into tissue box 303 through slot 309. Alternatively, the user may insert device 301 into box 303 while device 301 is locked in the closed position then release the studs from their apertures while device 301 is in box 303. The user may then return box 303 to an upright position. Spring 311 then extends upward to raise remaining tissues 305 directly to retrieval aperture 307 of box 303 to enable the user to easily access and remove remaining tissues 305 without the need to reach inside box 303, without contaminating tissues 305, and without unintentionally removing an undesired quantity of tissues 305. When box 303 is empty, the user may remove device 301 and use it with another container or store device 301 in the locked position. Device 301 can be used in all types of tissue boxes and in other types of containers such as, but not limited to, refillable baby wipe containers, cleaning wipe containers, paper towel dispensers, bath tissue containers, note paper dispensers, etc. In some variations tissue advancement devices may be made for specific use with particular facial tissue containers that feature means to accommodate the application of the devices, such as but not limited to a pre-cut sidewall slot or a perforated floorboard or sidewall that can be opened for the insertion of a device.

In the present embodiment, device 301 makes it faster and easier to access facial tissues 305 from box 303 by lifting tissues 305 to retrieval aperture 307 of box 303 and generally preventing tissues 305 from falling to the bottom of box 303, which generally ensures that tissues 305 remain easily accessible directly from retrieval aperture 307 even when box 303 is near empty. Device 301 generally eliminates the need to retrieve tissues 305 by inserting a hand or fingers into box 303. This helps preserve the cleanliness of facial tissues 305 within box 303 and generally eliminates the transfer of dirt and germs upon facial tissues 305 within box 303, which protects the user from secondary contamination and/or infection, generally prevents tissues 305 in box 303 from becoming a breeding ground of germs and helps users maintain their goals regarding their health. The easy access of tissues 305 with the use of device 301 helps anyone with dexterity and grip issues such as, but not limited to elderly, arthritic or otherwise relevantly disabled persons. Furthermore, device 301 can reduce waste by enabling a user to retrieve only the amount of tissue 305 they desire rather than unintentionally removing multiple sheets of tissue 305 when the contents of box 303 are low. Additionally, tissues 305 can easily tear when being retrieved by hand, and this tearing can make them unusable as intended. Device 301 generally eliminates this waste as well. Less tissue waste means less landfill waste or less flushing of the toilet to dispose of the tissue. Device 301 can extend the length of use of facial tissues containers by controlling this unintentional waste, which can save money and can satisfy environmental concerns of users.

Those skilled in the art, in light of the present teachings, will readily recognize that tissue advancement devices such as, but not limited to, device 301 may be used in a wide variety of environments. For example, without limitation, these devices can be beneficial for households, especially households that go through a lot of tissue such as, but not limited to, households with kids, elderly people, or those who suffer from allergies. Tissue advancement devices may also be used by the many public facilities that provide facial tissues within their environments such as, but not limited to, office buildings, hospitals, doctors' offices, schools, hotels, resorts, cruise lines, and many other facilities to help these facilities reduce waste, costs and liabilities and to help reduce the spread of germs.

Figure 4:
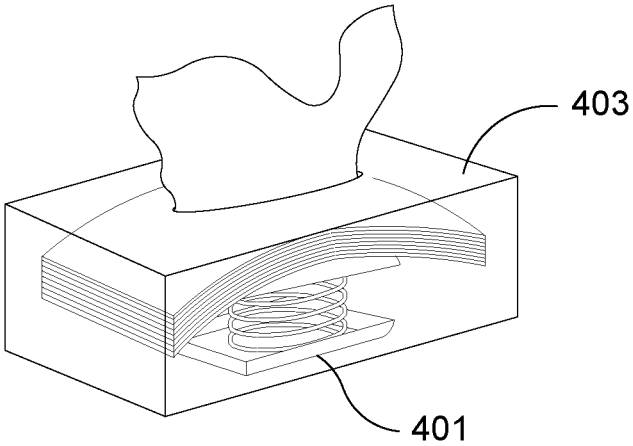
FIG. 4 is a partially transparent front perspective view of an exemplary tissue advancement device in use in a long rectangular tissue box, in accordance with an embodiment of the present invention.

FIG. 4 is a partially transparent front perspective view of an exemplary tissue advancement device 401 in use in a long rectangular tissue box 403, in accordance with an embodiment of the present invention. In the present embodiment, tissue advancement device 401 is used similarly to tissue advancement device 301, shown by way of example in FIGS. 3A and 3B. The slot for device 401 to be inserted into is preferably cut into the back of box 403 rather than the side for aesthetic reasons. Device 401 works particularly well with this type of the longer, rectangular box due to the fold of the tissues in these boxes. In some alternate embodiments the plates of the tissue advancement device may be made long and rectangular to match the shape of this type of container.

Figure 5:
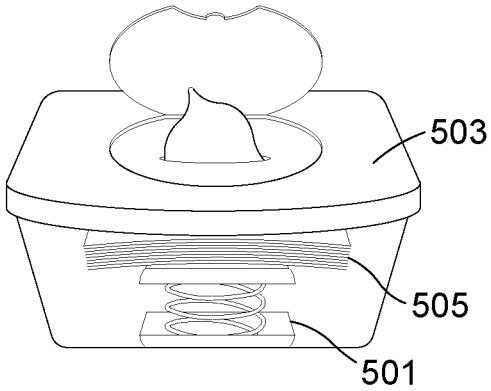
FIG. 5 is a partially transparent front perspective view of an exemplary tissue advancement device in use in a refillable baby wipe container, in accordance with an embodiment of the present invention.

FIG. 5 is a partially transparent front perspective view of an exemplary tissue advancement device 501 in use in a refillable baby wipe container 503, in accordance with an embodiment of the present invention. In the present embodiment, a user simply places device 501 into container 503 before container 503 is refilled with moist wipes 505. Device 501 then helps to push wipes 505 through a dispensing aperture 507.

Those skilled in the art, in light of the present teachings, will readily recognize that alternate embodiments may be implemented with a multiplicity of additional features such as, but not limited to, means for releasing fragrance, odor absorbers, nightlights, antimicrobial coatings, rustproof springs, etc. One alternate embodiment may comprise means for indicating the approximate quantity of tissues remaining such as, but not limited to, a thin, flexible plastic strip attached to the top plate that varies in color from the top to the bottom, for example, without limitation, from white to pink to red. As the top plate advances upward, this strip extends with it. The user can look into the slot into which the device was inserted to see what portion of the strip is showing and, depending on the color that is visible, know how far the device is extended. Another alternate embodiment of the present invention may be incorporated directly into facial tissue containers. In this embodiment, the top plate may be produced of a lightweight paperboard material or a lightweight plastic, and the end of the spring opposite the top plate may be attached directly to the lower plane of the container. Such embodiments may also be implemented in various different types of containers such as, but not limited to baby wipe containers. In addition, alternate embodiments can be produced in various colors and may or may not include various images and/or logos, which may or may not be of registered trademark and/or copyright status.

Having fully described at least one embodiment of the present invention, other equivalent or alternative methods of providing a tissue advancement device according to the present invention will be apparent to those skilled in the art. The invention has been described above by way of illustration, and the specific embodiments disclosed are not intended to limit the invention to the particular forms disclosed. For example, the particular implementation of the plates may vary depending upon the particular type of advancement means used. The advancement means described in the foregoing were directed to spring implementations; however, similar techniques are to use advancement means other than springs such as, but not limited to, materials that are able to compress and expand repeatedly such as, but not limited to, foam or sponges, or pieces of material such as, but not limited to, plastic or rubber formed into compressible shapes such as, but not limited to, z-shapes, circular shapes, v-shapes, etc. Non-spring implementations of the present invention are contemplated as within the scope of the present invention. The invention is thus to cover all modifications, equivalents, and alternatives falling within the spirit and scope of the following claims.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. An apparatus, comprising:

a first plate with a first perimeter, the first plate being configured to support a quantity of tissues within a tissue dispenser box;

a second plate with a second perimeter, the second plate being configured to rest on a bottom portion of the tissue dispenser box;

a resilient structure being configured to urge the first plate in an upward direction, the resilient structure being further configured to be positioned between the first plate and the second plate;

a plurality of attachment mechanisms joined to a bottom portion of the first plate and a top portion of the second plate, the attachment mechanisms being configured to join the resilient structure to the first plate and the second plate; and a plurality of finger tabs joined to the first plate and the second plate, in which the finger tabs are configured to be graspable in order to facilitate the release of a locking mechanism, in which the locking mechanism secures the first plate to the second plate to form a box to store the apparatus, and in which the locking mechanism comprises a plurality of studs and a plurality of opposing apertures.

2. The apparatus as recited in claim 1, in which the resilient structure comprises a spring.

3. The apparatus as recited in claim 2, in which the spring is coiled.

4. The apparatus as recited in claim 2, in which the attachment mechanisms comprise a plurality of sleeves removably joined to the spring.

5. The apparatus as recited in claim 1, in which the bottom portion of the first plate and the top portion of the second plate are concave.

6. The apparatus as recited in claim 1, in which the first plate perimeter and the second plate perimeter are each a rounded perimeter to form a radius edge about the secured plates.

7. The apparatus as recited in claim 1, in which the resilient structure is operable to maintain a top of the quantity of tissues proximate an opening to dispense the tissues of the tissue dispenser box.

8. The apparatus as recited in claim 7, in which the quantity of tissues comprises a plurality of wet wipes.

9. The apparatus as recited in claim 8, in which the tissue dispenser box is refillable.

10. The apparatus as recited in claim 1, in which the finger tabs project outward horizontally from the perimeters of the first plate and the second plate.

11. An apparatus, consisting of:

a first plate comprising a concave bottom portion and a first rounded perimeter, the first plate being configured to support a plurality of wet wipes within a refillable tissue dispenser box;

a second plate comprising a concave top portion and a second rounded perimeter, the second plate being configured to rest on a bottom portion of the refillable tissue dispenser box, the apparatus is configured to be inserted into the bottom portion of the refillable tissue dispenser box through a slot;

a coiled spring mechanism positioned between the first plate and the second plate, the coiled spring mechanism being configured to urge the first plate in an upward direction and being operable to maintain a top of the wet wipes proximate an opening to dispense the wet wipes of the refillable tissue dispenser box;

a plurality of sleeve mechanisms joined to the concave bottom portion of the first plate and the concave top portion of the second plate, the sleeve mechanisms being configured to removably join the coiled spring mechanism to the first plate and the second plate;

a plurality of studs and a plurality of opposing apertures to secure the first plate to the second plate to form a box with a radius edge to store the apparatus; and a plurality of finger tabs joined to the first plate and the second plate to project outward horizontally from the rounded perimeters of the first plate and the second plate, the finger tabs being configured to be graspable in order to facilitate the release of a locking mechanism.

* * * * *